US008682589B2

(12) United States Patent
Thigpen et al.

(10) Patent No.: US 8,682,589 B2
(45) Date of Patent: Mar. 25, 2014

(54) APPARATUS AND METHOD FOR MANAGING SUPPLY OF ADDITIVE AT WELLSITES

(75) Inventors: Brian L. Thigpen, Houston, TX (US); C. Mitch Means, Needville, TX (US); Guy P. Vachon, Houston, TX (US); Garabed Yeriazarian, Katy, TX (US); Jaedong Lee, Katy, TX (US); Chee M. Chok, Houston, TX (US); Clark Sann, Houston, TX (US); Xin Liu, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 1120 days.

(21) Appl. No.: 11/756,554

(22) Filed: May 31, 2007

(65) Prior Publication Data

US 2007/0289740 A1 Dec. 20, 2007

Related U.S. Application Data

(63) Continuation-in-part of application No. 11/737,402, filed on Apr. 19, 2007, and a continuation-in-part of application No. 11/052,429, filed on Feb. 7, 2005, now Pat. No. 7,389,787, which is a continuation-in-part of application No. 10/641,350, filed on Aug. 14, 2003, now Pat. No. 7,234,524, which is a continuation-in-part of application No. 09/658,907, filed on Sep. 11, 2000, now Pat. No. 6,851,444, which is a continuation-in-part of application No. 09/218,067, filed on Dec. 21, 1998, now abandoned.

(60) Provisional application No. 60/403,445, filed on Aug. 14, 2002, provisional application No. 60/153,175, filed on Sep. 10, 1999.

(51) Int. Cl.
*G01N 15/08* (2006.01)
*E21B 47/00* (2012.01)

(52) U.S. Cl.
USPC ..... 702/12; 166/252.1

(58) Field of Classification Search
USPC ..... 702/6–13, 1–2, 22–23, 30–32, 45, 50, 702/81, 84, 127, 137–138, 182–183, 702/188–189; 166/250.01, 250.05, 250.1, 166/252.1, 263, 266, 268–270, 270.1, 275, 166/305.1, 306, 369; 73/1.16, 73/152.18–152.19, 152.21–152.22, 73/152.29, 152.39
See application file for complete search history.

(56) References Cited

U.S. PATENT DOCUMENTS 3,211,225 A 10/1965 Thiessen et al.
3,664,420 A * 5/1972 Graham et al. ..... 166/280.2

(Continued)

FOREIGN PATENT DOCUMENTS

GB 2416871 A 2/2006
WO WO9857030 12/1998

(Continued)

OTHER PUBLICATIONS

Schlumberger, Well Test Interpretation, 2002, 126 pages.

(Continued)

*Primary Examiner* — Toan Le
(74) *Attorney, Agent, or Firm* — Cantor Colburn LLP

(57) ABSTRACT

A system and method for supplying an additive into a well is disclosed that includes estimating injection rates for the additives and setting of one or more fluid flow control devices in the well based on a computer model. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

20 Claims, 4 Drawing Sheets

(56) References Cited

U.S. PATENT DOCUMENTS

| | | | | | |
|---|---|---|---|---|---|
| 3,707,192 | A | * | 12/1972 | Goins et al. | 166/300 |
| 3,710,867 | A | | 1/1973 | Bansbach | |
| 3,763,932 | A | * | 10/1973 | Dinning | 166/72 |
| 3,954,006 | A | | 5/1976 | Anderson et al. | |
| 3,991,827 | A | | 11/1976 | Schall | |
| 4,064,936 | A | | 12/1977 | McClure | |
| 4,284,143 | A | | 8/1981 | Scherrer et al. | |
| 4,354,553 | A | * | 10/1982 | Hensley | 166/250.05 |
| 4,375,833 | A | | 3/1983 | Meadows | |
| 4,436,148 | A | | 3/1984 | Maxwell | |
| 4,582,131 | A | | 4/1986 | Plummer et al. | |
| 4,589,434 | A | | 5/1986 | Kelley | |
| 4,635,723 | A | | 1/1987 | Spivey | |
| 4,665,981 | A | | 5/1987 | Hayatdavoudi | |
| 4,721,158 | A | * | 1/1988 | Merritt et al. | 166/250.01 |
| 4,830,112 | A | | 5/1989 | Erickson | |
| 4,843,247 | A | | 6/1989 | Yamazoe et al. | |
| 4,901,563 | A | * | 2/1990 | Pearson | 73/152.31 |
| 4,926,942 | A | * | 5/1990 | Profrock, Jr. | 166/250.15 |
| 5,006,845 | A | | 4/1991 | Calcar et al. | |
| 5,172,717 | A | * | 12/1992 | Boyle et al. | 137/155 |
| 5,209,301 | A | | 5/1993 | Ayres | |
| 5,253,707 | A | * | 10/1993 | Schmidt et al. | 166/270 |
| 5,305,209 | A | * | 4/1994 | Stein et al. | 702/13 |
| 5,353,237 | A | * | 10/1994 | Bass et al. | 700/272 |
| 5,517,593 | A | | 5/1996 | Nenniger et al. | |
| 5,647,435 | A | * | 7/1997 | Owens et al. | 166/250.01 |
| 5,706,896 | A | * | 1/1998 | Tubel et al. | 166/313 |
| 5,767,680 | A | * | 6/1998 | Torres-Verdin et al. | 324/355 |
| 5,829,520 | A | * | 11/1998 | Johnson | 166/250.01 |
| 5,937,946 | A | * | 8/1999 | Streetman | 166/267 |
| 6,006,832 | A | | 12/1999 | Tubel et al. | |
| 6,061,634 | A | | 5/2000 | Belani et al. | |
| 6,070,663 | A | | 6/2000 | Cernocky et al. | |
| 6,196,314 | B1 | | 3/2001 | Chen | |
| 6,281,489 | B1 | * | 8/2001 | Tubel et al. | 250/227.14 |
| 6,467,340 | B1 | | 10/2002 | Gallagher et al. | |
| 6,543,540 | B2 | | 4/2003 | Woie et al. | |
| 6,645,769 | B2 | | 11/2003 | Tayebi et al. | |
| 6,795,773 | B2 | | 9/2004 | Soliman et al. | |
| 6,851,444 | B1 | | 2/2005 | Kohl et al. | |
| 6,874,361 | B1 | | 4/2005 | Meltz et al. | |
| 6,880,633 | B2 | * | 4/2005 | Wellington et al. | 166/245 |
| 7,434,619 | B2 | | 10/2008 | Rossi et al. | |
| 7,484,563 | B2 | | 2/2009 | Zazovsky et al. | |
| 7,805,248 | B2 | * | 9/2010 | Thigpen et al. | 702/6 |
| 2002/0043370 | A1 | | 4/2002 | Poe | |
| 2002/0179301 | A1 | | 12/2002 | Schultz et al. | |
| 2003/0079912 | A1 | | 5/2003 | Leuchtenberg | |
| 2004/0084180 | A1 | | 5/2004 | Shah et al. | |
| 2004/0262008 | A1 | | 12/2004 | Deans et al. | |
| 2005/0149264 | A1 | * | 7/2005 | Tarvin et al. | 702/6 |
| 2005/0173114 | A1 | | 8/2005 | Cudmore et al. | |
| 2007/0078610 | A1 | | 4/2007 | Adams et al. | |
| 2007/0289739 | A1 | | 12/2007 | Cooper et al. | |
| 2008/0201080 | A1 | | 8/2008 | Lovell et al. | |

FOREIGN PATENT DOCUMENTS

| | | | | | |
|---|---|---|---|---|---|
| WO | WO9957417 | | | 11/1999 | |
| WO | WO0000716 | | | 1/2000 | |
| WO | WO02063130 | A1 | | 8/2002 | |
| WO | WO 02063130 | A1 | * | 8/2002 | E21B 43/00 |
| WO | WO2005045371 | A1 | | 5/2005 | |
| WO | WO2006127939 | A2 | | 11/2006 | |

OTHER PUBLICATIONS

M.C.T. Kuo, "Correlations rapidly analyze water coning," Technology, Oct. 2, 1989, Oil and Gas Journal, pp. 77-80.

* cited by examiner

APPARATUS AND METHOD FOR MANAGING SUPPLY OF ADDITIVE AT WELLSITES

RELATED APPLICATIONS

This application is a continuation-in-part of U.S. patent application Ser. No. 11/737,402, filed on Apr. 19, 2007 (pending) and is a continuation-in-part of U.S. patent application Ser. No. 11/052,429, filed on Feb. 7, 2005, now U.S. Pat. No. 7,389,787, which is a continuation-in-part of U.S. patent application Ser. No. 10/641,350, filed Aug. 14, 2003, now U.S. Pat. No. 7,234,524 which takes priority from U.S. Provisional Patent Application No. 60/403,445, filed on Aug. 14, 2002, which is a continuation-in-part of U.S. patent application Ser. No. 09/658,907, filed on Sep. 11, 2000, which issued as U.S. Pat. No. 6,851,444, which is a continuation-in-part of U.S. Provisional Patent Application Ser. No. 60/153,175, filed on Sep. 10, 1999 and U.S. patent application Ser. No. 09/218,067, filed on Dec. 21, 1998, now abandoned.

BACKGROUND OF THE DISCLOSURE

1. Field of the Disclosure

This disclosure relates generally to a system and methods for managing the supply of additives or chemicals into wellbores and wellsite hydrocarbon transporting and processing units.

2. Background of the Art

A variety of chemicals (also referred to herein as "additives") are often introduced into producing wells and wellsite hydrocarbon treatment and processing units so as to control formation of, among other things, corrosion, scale, paraffin, emulsion, hydrate, hydrogen sulfide, asphaltene and other harmful chemicals. In production wells, additives are usually injected through one or more tubes (also referred to herein as lines) that are run from the surface to one or more locations in the wellbore. Additives are introduced proximate electrical submersible pumps (as shown for example in U.S. Pat. No. 4,582,131, which is assigned to the assignee hereof and incorporated herein by reference). The additives may be introduced through an auxiliary tube associated with a power cable used with the electrical submersible pump ("ESP") (such as shown in U.S. Pat. No. 5,528,824, assigned to the assignee hereof and incorporated herein by reference). Additives also are introduced into adjacent production zones to inhibit the formation of the harmful chemicals. Additionally, additives often introduced into the wellsite fluid treatment and processing apparatus and pipeline transporting the treated hydrocarbons from the wellsite.

For oil well applications, a high pressure pump is typically used to inject one or more additives into the well from a source thereof at the wellsite, such as a chemical tank. The pump is usually set to operate continuously at a designated speed (frequency) or at a specified stroke length to control the amount of the injected additive. A separate pump and an injector are typically used for each type of additive. Manifolds are sometimes used to inject additives into multiple wells from a common additive source. A substantial number of wells are unmanned. A large number of such wells are located in unmanned remote areas or offshore platforms. Additive injection systems used at such wells are often not serviced routinely, which can result in the malfunction of such a system, thereby either injecting incorrect amounts of additives or in some cases becoming totally inoperative. Injecting excessive amounts of additives can increase the operating cost of the well, while inadequate amounts of the additives can cause the formation of scale, corrosion, hydrate, emulsion, asphaltene.

The operating condition of a well, the effectiveness of the equipment in the well, as well as those of the production zones (reservoirs) often change over time, requiring altering the amount and type of the additives for preserving the health of downhole equipment and for the efficient production of hydrocarbons at optimal costs. The changes in the well conditions may occur due to: changes in the fluid flow rates from one or more production zones; changes in the composition of the produced fluids, such as the amount of water in the fluid; formation of chemicals downhole, such as scale, corrosion, paraffin, hydrate, emulsions, asphaltene, etc.; depletion of the additives in the surface tank or leaks in the additive tanks or tubes; failure of one or more downhole devices, such as a valve, choke, and ESP; degradation of casing and cement bond between the casing and the formation; water breakthrough or the occurrence of a cross flow condition, etc. Inadequate or incorrect supply of additives can cause the build-up of chemicals such as cale, hydrate, paraffin, emulsion, corrosion, asphaltene, etc., which can: clog and corrode downhole equipment; reduce hydrocarbon production from the well; reduce the operating life of the well equipment; reduce the operating life of the well itself; require expensive rework operations; or cause the abandonment of the well. Excessive corrosion in a pipeline, especially in a subsea pipeline, can reduce the flow through the pipeline or rupture the pipeline and contaminate the surrounding environment. Repairing subsea pipelines can be cost-prohibitive.

Commercially-used well site additive injection systems usually require periodic manual inspection to determine whether the additives are being dispensed correctly. Such systems typically do not supply relatively precise amounts of additives or continuously monitor the actual amount of the additives being dispensed, determine the impact of the dispersed additives, vary the amount of dispersed additives as needed to maintain certain parameters of interest within their respective desired ranges, communicate necessary information to onsite personnel (when present) and offsite locations and take actions in response to commands received from such onsite and offsite locations. Such systems also typically do not control additive injection into multiple wells in an oilfield or into multiple wells at a wellsite, such as an offshore production platform.

Additionally, the present chemical injection systems do not determine the overall impact of various chemicals being produced on the equipment in the well, flow rates from each production zone and the overall economic impact on the production from the well. Such systems also do not tend to optimize or maximize fluid production from different zones or the well as a whole, perform forward looking analysis or take actions corresponding to such forward looking analysis.

Therefore, there is a need for an improved chemical injection system.

SUMMARY OF THE DISCLOSURE

A system and method for managing the supply of an additive at a well site is disclosed that include supplying the additive into a well from a source thereof at a first injection rate into one or more production zones of well; determining a formation fluid flow rate for the fluid produced by the wellbore; determining a second injection rate corresponding to the determined fluid flow rate; and adjusting the additive injection rate to the second injection rate. The method and system utilize a computer model that utilizes a plurality of inputs stored in a database and measurements made during the production of the fluids from the well. The computer model and other computer programs are used by a processor associated with a controller or a computer for executing the methods described herein. The computer model may utilize a nodal analysis, neural network analysis, or a forward looking analysis to determine actions to be performed.

Examples of the more important features of a system for managing the supply of additives at well sites have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the chemical injection apparatus and methods described and claimed herein, reference should be made to the following detailed description of the preferred embodiments, taken in conjunction with the accompanying drawings, in which like elements generally have been given like numerals, wherein:

DETAILED DESCRIPTION OF PREFERRED EMBODIMENTS

Figure 1A:
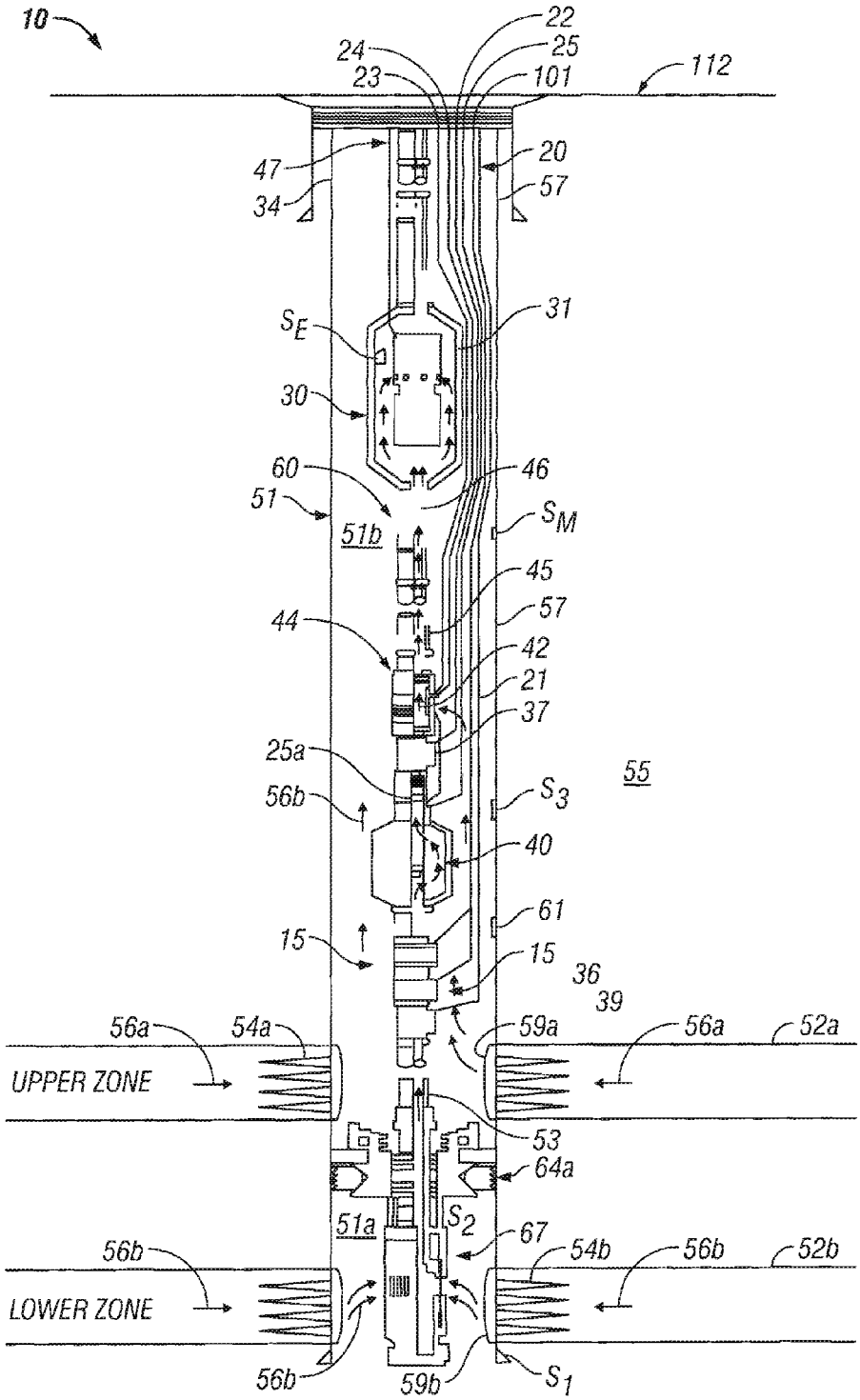
FIGS. 1A and 1B collectively show a schematic diagram of a chemical injection and management system according to one embodiment of the disclosure.
Figure 1B:
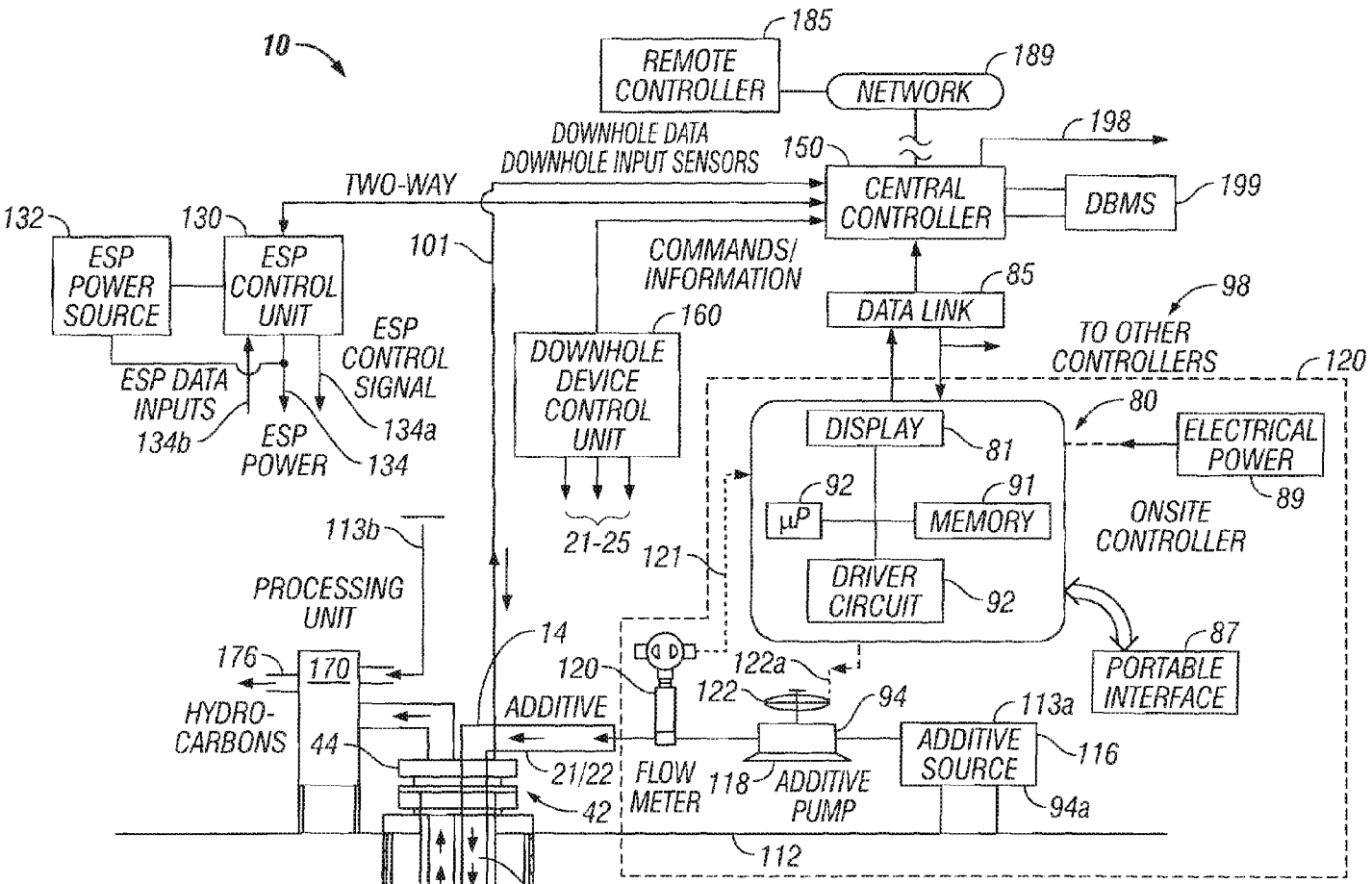

FIGS. 1A and 1B collectively show a schematic diagram of a wellsite additive management system 10, according to one embodiment of the disclosure. FIG. 1A shows a production wellbore 50 that has been configured using exemplary equipment, devices and sensors that may be utilized to implement the concepts and methods described herein. FIG. 1B shows exemplary surface equipment, devices, controllers and sensors that may be utilized to manage the operation of various devices in the system 10, including the supply of the additives into the well and the surface equipment in response to the downhole conditions, surface conditions and according to programmed instruction, and/or a nodal analysis, use of a neural network or other algorithms. In one aspect, the system 10 manages the supply of the additives to one or more locations in the wellbore and in another aspect manages the supply of additives to the surface fluid treatment and processing units and the pipelines at the well site that may carry the produced or treated fluids.

FIG. 1A shows a well 50 formed in a formation 55 that produces formation fluids 56*a* and 56*b* from two exemplary production zones 52*a* (upper production zone) and 52*b* (lower production zone) respectively. The well 50 is shown lined with a casing 57 that has perforations 54*a* adjacent the upper production zone 52*a* and perforations 54*b* adjacent the lower production zone 52*b*. A packer 64, which may be a retrievable packer, positioned above or uphole of the lower production zone perforations 54*a* isolate the lower production zone 52*b* from the upper production zone 52*a*. A screen 59*b* adjacent the perforations 54*b* may be installed to prevent or inhibit solids, such as sand, from entering into the wellbore from the lower production zone 54*b*. Similarly, a screen 59*a* may be used adjacent the upper production zone perforations 59*a* to prevent or inhibit solids from entering into the well 50 from the upper production zone 52*a*.

The formation fluid 56*b* from the lower production zone 52*b* enters the annulus 51*a* of the well 50 through the perforations 54*a* and into a tubing 53 via a flow control valve 67. The flow control valve 67 may be a remotely controlled sliding sleeve valve or any other suitable valve or choke that can regulate the flow of the fluid from the annulus 51*a* into the production tubing 53. An adjustable choke 40 in the tubing 53 may be used to regulate the fluid flow from the lower production zone 52*b* to the surface 112. The formation fluid 56*a* from the upper production zone 52*a* enters the annulus 51*b* (the annulus portion above the packer 64*a*) via perforations 54*a*. The formation fluid 56*a* enters production tubing or line 45 via inlets 42. An adjustable valve or choke 44 associated with the line 45 regulates the fluid flow into the line 45 and may be used to adjust flow of the fluid to the surface 112. Each valve, choke and other such device in the well may be operated electrically, hydraulically, mechanically and/or pneumatically from the surface. The fluid from the upper production zone 52*a* and the lower production zone 52*b* enter the line 46.

In cases where the formation pressure is not sufficient to push the fluid 56*a* and/or fluid 56*b* to the surface, an artificial lift mechanism, such as an electrical submersible pump (ESP), gas lift system or other desired systems may be utilized to lift the fluids from the well to the surface 112. In the system 10, an ESP 30 in a manifold 31 is shown as the artificial lift mechanism, which receives the formation fluids 56*a* and 56*b* and pumps such fluids via tubing 47 to the surface 112. A cable 34 provides power to the ESP 30 from a surface power source 132 (FIG. 1B) that is controlled by an ESP control unit 130. The cable 134 also may include two-way data communication links 134*a* and 134*b*, which may include one or more electrical conductors or fiber optic links to provide a two-way signals and data link between the ESP 30, ESP sensors $S_E$ and the ESP control unit 130. The ESP control unit 130, in one aspect, controls the operation of the ESP 30. The ESP control unit 130 may be a computer-based system that may include a processor, such as a microprocessor, memory and programs useful for analyzing and controlling the operations of the ESP 30. In one aspect, the controller 130 receives signals from sensors $S_E$ (FIG. 2A) relating to the actual pump frequency, flow rate through the ESP, fluid pressure and temperature associated with the ESP 30 measurements or information relating to certain chemicals, such as corrosion, scale, hydrate, paraffin, emulsion, asphaltene, etc. and in response thereto or other determinations controls the operation of the ESP 30. In one aspect, the ESP control unit 130 may be configured to alter the ESP pump speed by sending control signals 134*a* in response to the data received via link 134*b* or instructions received from another controller. The ESP control unit 130 may also shut down power to the ESP via the power line 134. In another aspect, ESP control unit 130 may provide the ESP related data and information (frequency, temperature, pressure, chemical sensor information, etc.) to the central controller 150, which in turn may provide control or command signals to the ESP control unit 130 to effect selected operations of the ESP 30.

A variety of hydraulic, electrical and data communication lines (collectively designated by numeral 20 (FIG. 1A) are run inside the well 50 to operate the various devices in the well 50 and to obtain measurements and other data from the various sensors in the well 50. As an example, a tube or tubing 21 may supply or inject a particular chemical from the surface into the fluid 56*b* via a mandrel 36. Similarly, a tubing 22 may supply or inject a particular chemical to the fluid 56*a* in the production tubing via a mandrel 37. Separate lines may be used to supply the additives at different locations in the well 50 or to supply different types of additives. Lines 23 and 24 may operate the chokes 40 and 42 and may be used to operate any other device, such as the valve 67. Line 25 may provide electrical power to certain devices downhole from a suitable surface power source. Two-way data communication links between sensors and/or their associated electronic circuits (generally denoted by numeral 25*a* and located at any one or more suitable downhole locations) may be established by any desired method including but not limited to via wires, optical fibers, acoustic telemetry using a fluid line, electromagnetic telemetry, etc.

In one aspect, a variety of sensors are placed at suitable locations in the well 50 to provide measurements or information relating to a number of downhole parameters of interest. In one aspect, one or more gauge or sensor carriers, such as a carrier 15, may be placed in the production tubing to house any number of suitable sensors. The carrier 15 may include one or more temperature sensors, pressure sensors, flow measurement sensors, resistivity sensors, sensors that may provide information about density, viscosity, water content or water cut, etc., and chemical sensors that provide information about scale, corrosion, hydrate, paraffin, hydrogen sulphide, emulsion, asphaltene, etc. Density sensors provide fluid density measurements for fluid produced from each production zone and that of the combined fluid from two or more production zones. The resistivity sensor or another suitable sensor may provide measurements relating to the water content or the water cut of the fluid mixture received from each production zones. Other sensors may be used to estimate the oil/water ratio and gas/oil ratio for each production zone and for the combined fluid. The temperature, pressure and flow sensors provide measurements for the pressure, temperature and flow rate of the fluid in the line 53. Additional gauge carriers may be used to obtain pressure, temperature and flow measurements, and water content relating to the formation fluid received from the upper production zone 52*a*. Additional downhole sensors may be used at other desired locations to provide measurements relating to the presence and extent of chemicals downhole. Additionally, sensors $S_1$-$S_m$ may be permanently installed in the wellbore 50 to provide acoustic or seismic or microseismic measurements, formation pressure and temperature measurements, resistivity measurements and measurements relating to the properties of the casing 51 and formation 55. Such sensors may be installed in the casing 57 or between the casing 57 and the formation 55. Microseismic and other sensors may be used to detect water fronts, which may imbalance the composition of the fluids being produced, thereby providing early warning relating to the formation of certain chemicals. Pressure and temperature changes or expected changes may provide early warning of changes in the chemical composition of the production fluid. Additionally, the screen 59*a* and/or screen 59*b* may be coated with tracers that are released due to the presence of water, which tracers may be detected at the surface or downhole to determine or predict the occurrence of water breakthrough. Sensors also may be provided at the surface, such as a sensor for measuring the water content in the received fluid, total flow rate for the received fluid, fluid pressure at the wellhead, temperature, etc. Other devices may be used to estimate the production of sand for each zone.

In general, sufficient sensors may be suitably placed in the well 50 to obtain measurements relating to each desired parameter of interest. Such sensors may include, but are not limited to: sensors for measuring pressures corresponding to each production zone, pressure along the wellbore, pressure inside the tubings carrying the formation fluid, pressure in the annulus; sensors for measuring temperatures at selected places along the wellbore; sensors for measuring fluid flow rates corresponding to each of the production zones, total flow rate, flow through the ESP; sensors for measuring ESP temperature and pressure; chemical sensors for providing signals relating to the presence and extent of chemicals, such as scale, corrosion, hydrates, paraffin, emulsion, hydrogen sulphide and asphaltene; acoustic or seismic sensors that measure signals generated at the surface or in offset wells and signals due to the fluid travel from injection wells or due to a fracturing operation; optical sensors for measuring chemical compositions and other parameters; sensors for measuring various characteristics of the formations surrounding the well, such as resistivity, porosity, permeability, fluid density, etc. The sensors may be installed in the tubing in the well or in any device or may be permanently installed in the well, for example, in the wellbore casing, in the wellbore wall or between the casing and the wall. The sensors may be of any suitable type, including electrical sensors, mechanical sensors, piezoelectric sensors, fiber optic sensors, optical sensors, etc. The signals from the downhole sensors may be partially or fully processed downhole (such as by a microprocessor and associated electronic circuitry that is in signal or data communication with the downhole sensors and devices) and then communicated to the surface controller 150 via a signal/data link, such as link 101. The signals from downhole sensors may also be sent directly to the controller 150.

FIG. 1B shows exemplary surface equipment that may be used to manage injection of additives into the well 50 so as to enhance production from one or more zones and to increase the life equipment in the well. The exemplary surface equipment is shown to include a chemical injection unit 120 that supplies additives 113*a* to the well 50 and additives 113*b* to the surface fluid treatment unit 170. FIG. 1B also is shown to include an ESP control unit 130, a central controller 150, and a downhole device actuator unit 160. The interaction, operations and functions of such units are described below.

The desired additive(s) 113*a* from a source 116*a* (such as a storage tank) thereof are injected into the wellbore 50 via injection lines 21 and 22 by a suitable pump, such as a positive displacement pump 118 ("additive pump"). The additives 113*a* flow through the lines 21 and 22 and discharge into manifolds 30 and 37. The same or different injection lines may be used to supply additives to different production zones. Separate injection lines, such as lines 21 and 22, allow independent injection of different additives at different well depths in desired amounts. In such a case, different additive sources and pumps may be employed to store and to pump the desired additives. Similar methods may be used for injection of additives in a pipeline such as line 176 or a surface treatment and processing facility such as unit 170.

A suitable flow meter 120, which may be a high-precision, low-flow, flow meter (such as gear-type meter or a nutating meter), may be used to measure flow rates through lines 21 and 22, and provides signals representative of the flow rates. The pump 118 may be operated by any suitable device 122, such as a motor, compressed air device, etc. The stroke of the pump 118 may be used to define fluid volume output per stroke. The pump stroke and/or the pump speed may be controlled by the controller 80 via a driver circuit 92 and control line 122*a*. The controller 80 may control the pump by utilizing programs stored in a memory 91 associated with the controller 80 and/or instructions provided to the controller 80 from a central controller or processor 150 or a remote controller 185. The controller 80 may include a microprocessor 90, resident memory 91, such as a solid state memory, such as a read-only memory (ROM)), for storing programs, tables and models, and random access memory (RAM), for storing data. The microprocessor 90, utilizing signals from the flow meter 120 received via line 121 and programs stored in the memory 91 determines the flow rate of each of the additives and displays such flow rates on a display 81. The controller 80 may be programmed to alter the pump speed, pump stroke or power (electrical or air supply, etc.) to the device 118 to control the amount of the additive 113*a* supplied. The pump speed or stroke, as the case may be, may be increased when the measured amount of the additive injected is less than the desired amount and decreased when the injected amount is greater than the desired amount. The controller 80 also includes circuits and programs, generally designated by numeral 92 to provide interface with the onsite display 81 and to perform other desired functions.

The controller 80 may be configured to poll, periodically or substantially continuously, the flow meter 120 and to determine therefrom the additive injection flow rate and generate data/signals which may be transmitted to the central controller 150 via a data link 85. Any suitable two-way data link 85 may be utilized. Such data links may include, among others, telephone modems, radio frequency transmission, microwave transmission and satellites utilizing EIA-232 or EIA-485 communications protocols or any other suitable link. It should be understood that separate controllers are shown merely to facilitate the present description. In embodiments, a single local or remote controller may be used to control all activities. In other embodiments, two or more controllers may be used to cooperatively control the additive injection activity and other operations of the well system 10.

The central controller 150 may be a computer-based system and may transmit command signals to the controller 80 via the data link 85. The central controller 150 is provided with models/programs to determine the desired amount of the additives to be injected. If the desired amount differs from the measured amount, it may send corresponding command signals to the controller 80. The controller 80 receives the command signals and adjusts the flow rate of the additive 113*a* into the well 50 accordingly. The central controller 150 receives information from a variety of sources and utilizes that information to estimate the desired amounts of the additive and controls the system 10 as described in more detail later. The additive system may be a partially closed-loop system that utilizes prompts to allow human intervention or a fully closed-loop control system that does not utilize human intervention. The controls may be affected by the central controller 150 remote controller 185 or a combination of these and other controllers.

In one aspect, the controller 80 may include protocols so that the flow meter 120, pump control device 122, and data links 185 made by different manufacturers may be utilized in the system 10. In the oil industry, the analog output for pump control is typically configured for 0-5 VDC or 4-20 milliampere (mA) signal. In one mode, the controller 80 may be programmed to operate for such an output. This allows for the system 10 to be used with existing pump controllers. A suitable source of electrical power source 89, e.g., a solar-powered DC or AC power unit, or an onsite generator provides power to the controller 80 and other electrical circuit elements of the system 10. The controller 80 is also provided with a visual display 81 that displays the flow rates of the individual flow meters. The display 81 may be scrolled by an operator to view any of the flow meter readings, the desired additive flow rate tank level, anticipated depletion rate, or other relevant information. The display 81 is controllable either by a signal from the central controller 150 and/or the remote controller 185 and also may be viewed or controlled by a suitable portable interface device 87 at the well site, such as an infrared device or a key pad. This allows an operator at the wellsite to view the displayed data non-intrusively without removing the protective casing of the controller.

Still referring to FIGS. 1A and 1B, the produced fluids (56*a* and 56*b*) received at the surface may be processed by a treatment or processing unit 170. The surface processing unit 170 may be of the type that processes the fluids to remove solids and certain other materials such as hydrogen sulfide, or that processes the fluids to produce semi-refined to refined products. In such systems, it is desirable to monitor the characteristics of the fluids in the fluid treatment unit 170 and to control the injection of additives in response to one or more such characteristic. A system, such as system 10 shown in FIGS. 1A and 1B, may be used for monitoring the characteristics of the fluids in the system 170 and for injecting and monitoring additives 113*b* into the fluid treatment unit 170.

Still referring to FIG. 1B, in addition to the flow rate signals 121 from the flow meter 120, the controller 80 may be configured to receive signals representative of other parameters, such as the rpm of the pump 118, or the motor 122 or the modulating frequency of a solenoid valve. In one mode of operation, the controller 80 may periodically poll the meter 120 and automatically adjust the pump controller 122 via an analog input 122*a* or alternatively via a digital signal of a solenoid controlled system (pneumatic pumps). The controller 80 also may be programmed to determine whether the pump output, as measured by the meter 120, corresponds to the level of signal 122*a*. This information may be used to determine the pump efficiency. This also may be an indication of a leak or another abnormality relating to the pump 118. Other sensors 94, such as vibration sensors and temperature sensors may be used to determine the physical condition of the pump 118. Sensors that determine properties or characteristics of the wellbore fluid provide information of the treatment effectiveness of the additives being injected, which information may then be used to adjust the additive flow rate as more fully described below in reference to FIG. 2. Also, the central controller 150 may control multiple controllers via a link 198. A data base management system 199 may be provided for the central controller 150 that may contain, among other things, historical monitoring and management of data. The central controller 150 may further be configured or adapted to communicate with other locations (remote units) 185 via a network 189 (such as the Internet) so that operators may log into and access the database 199 and monitor and control additive injection of any well associated with the system 10.

Still referring to FIGS. 1A and 1B, the system 10 includes an ESP control unit 130 that controls the operation of the ESP 30 in the wellbore 50. The ESP control unit may include a processor, such as a microprocessor, memory and programs useful for controlling the ESP 30. In one aspect the controller 130 controls the ESP pump power and speed (frequency) and in another aspect receives signals from sensors $S_E$ (FIG. 1A) relating to the actual pump frequency, flow rate through the ESP, fluid pressure and temperature associated with the ESP and may obtain measurements relating to certain chemical properties, such as corrosion, scaling, asphaltenes etc. In one aspect, the ESP control unit 130 may be configured to alter the ESP pump speed by sending control signals 134*a* in response to the data received via links 134*a*. The ESP control unit 130 may shut down the power to the ESP via the power line 134. In another aspect, the ESP control unit 130 may provide ESP data and information to the central controller 150, which in turn may provide control signals to the ESP control unit 130 to control certain operations of the ESP 30.

In one aspect, the central controller 150 may manage the use of chemicals in the system 10, including injection of additives into a well and into the surface treatment units and pipelines. In one aspect, the central controller 150 receives signals (measurements) from the various downhole sensors, information and signals from the ESP control unit 130 and information and signals from the chemical injection unit 120. The central control unit 150, which as noted earlier, may be a computer-based system that has a variety of computer programs, algorithms and a database associated therewith. The central controller 150, in one aspect, receives signals for the various flow measuring sensors or devices, such as the flow sensors associated with each production zone 52*a* and 52*b*, the total flow rate sensor in the wellbore or at the surface, the ESP pump frequency, etc., and utilizes one or more such measurements to determine the appropriate amount of one or more selected additives for each of the production zones in the well and sends an appropriate signal to the controller 80 to adjust the amount of chemicals being injected to the desired levels. Thus, in one aspect the system 10 sets the chemical injection rate in response to the fluid flow rates from each production zone and/or in response to the total flow rate. In another aspect, the central controller 150 determines water cut from downhole sensor measurements and/or from the analysis of the produced fluid performed at the surface and in response thereto determines the desired amounts of the additives for each production zone and sends command signals to the controller 80 to adjust the additive injection rates accordingly. In addition, the central controller 150 may utilize a nodal network or another model to predict the changes in the flow rate due to an anticipated action, such as the closing of a particular choke, and in response thereto cause the ESP to alter its speed via the ESP control unit 130 and adjust the amount and/or type of chemical injected into the well through the controller 80.

In another aspect, the controller 150 may estimate or determine the changes in the downhole condition, such as flow changes due to scaling, paraffin build-up, presence of asphaltenes, corrosion etc. to determine the effective amount and type of additives to be supplied to the well 50. Thus, in general, the central controller 150 may receive a variety of inputs (downhole measurements, surface flow measurements, chemical injection rates, ESP operational parameters, etc.) and in response to one or more such inputs, may determine the amount of chemicals to be supplied to one or more zones in a well and may effect the desired change via one or more controllers, such as a controllers 80 and 130.

In another aspect, the central controller 150 may be configured to control the operation of selected downhole devices via a downhole device actuator or control unit 140. The control unit 140 controls the operation of the various downhole and surface devices, such as valves, chokes, sliding sleeve valves, etc. The central controller 150 may alter the operation of any device in the system 10. For example, if the flow rate drops to an undesirable level from a particular production zone, the central controller 150 may close a corresponding choke, stop chemical injection to that zone and alter the ESP pump speed. In another aspect, the central controller 150 may analyze the effects of a chemical buildup, such as corrosion, asphaltenes and may alter the amount and type of chemicals to be supplied and/or alter the ESP pump speed and/or reduce the flow fluid flow or cut off the flow from a particular zone or cause the well to shut down.

In another aspect, the central controller 150 may receive signals from an additive tank 113, sensor 117 relating to the amount of additive left in the tank, such as the chemical level, and periodically estimate the remaining injection time till depletion of the tank. The central controller 150 may also estimate the consumption rates and amounts based on the predicted flow rates and other anticipated changes in the wellbore conditions and provide to the wellsite personnel and/or the remote controller 185 such information. The central controller also may determine the amount of the chemical left in the tank 116, consumption rate and the time till depletion. Additionally, the central controller 150 may calculate the costs relating to the past and projected use of the additives in relation to the amounts of hydrocarbons produced from each production zone. Also, when the additive levels in the tank 113 show a depletion rate greater than the set injection rate, the central controller 150 may estimate the extent of any leak in the system, such as a leak in the tank or in a line associated therewith and send an alarm condition to the wellsite operator and/or to the remote controller 185.

As will be appreciated by those versed in the art, in embodiments, the availability of sensor data to the controller enable the controller to relatively promptly initiate a system response to a measured condition with limited or no human assistance. Thus, for instance, a change in system operating parameter or a combination of parameters, downhole or at a surface or a combination thereof, may be executed within a relatively short time, such as in minutes or hours of a detected condition, instead of longer time periods, such days or months. Additionally, in embodiments, the controller may evaluate the effectiveness of the applied change and initiate further action, if necessary.

Although FIGS. 1A and 1B illustrate one production well penetrating through two production zones, the well system 10 may include a single production zone or more than two zones, each zone may further include one or more lateral wells or any other suitable well configuration. The flow control devices described above and other suitable downhole and surface devices may be utilized in any such well configuration for managing supply of chemicals and for enhancing or maximizing production from any particular zone and/or the well as a whole. Further, the flow control devices may adjust flow rates independently for each production zone. The above-described sensors and other suitable sensors may take measurement relating to one or more parameters of interest, including, but not limited to, parameters relating to the wellbore, the subsurface equipment, the formation, and/or the production fluid. The measurements made by these sensors may be provided to the central controller 185 in real-time, near real-time, periodically or as needed.

Often several wells (for example, 10-20) are drilled from a common location such as an offshore platform or a land ring drilling multilateral wells. After the wells are completed and producing, a separate pump and flow meter may be installed to inject additives into each well. A common central controller, such as controller 150 (FIG. 1B) may be used to control each of the pumps to inject the additives in the manner described herein. Also, a controller, such as controller 150 with or without the use of a remote controller, such as controller 185, may be utilized to manage additive injection as described herein in wells drilled at different physical locations, for example wellbores drilled in a common field.

Figure 2:
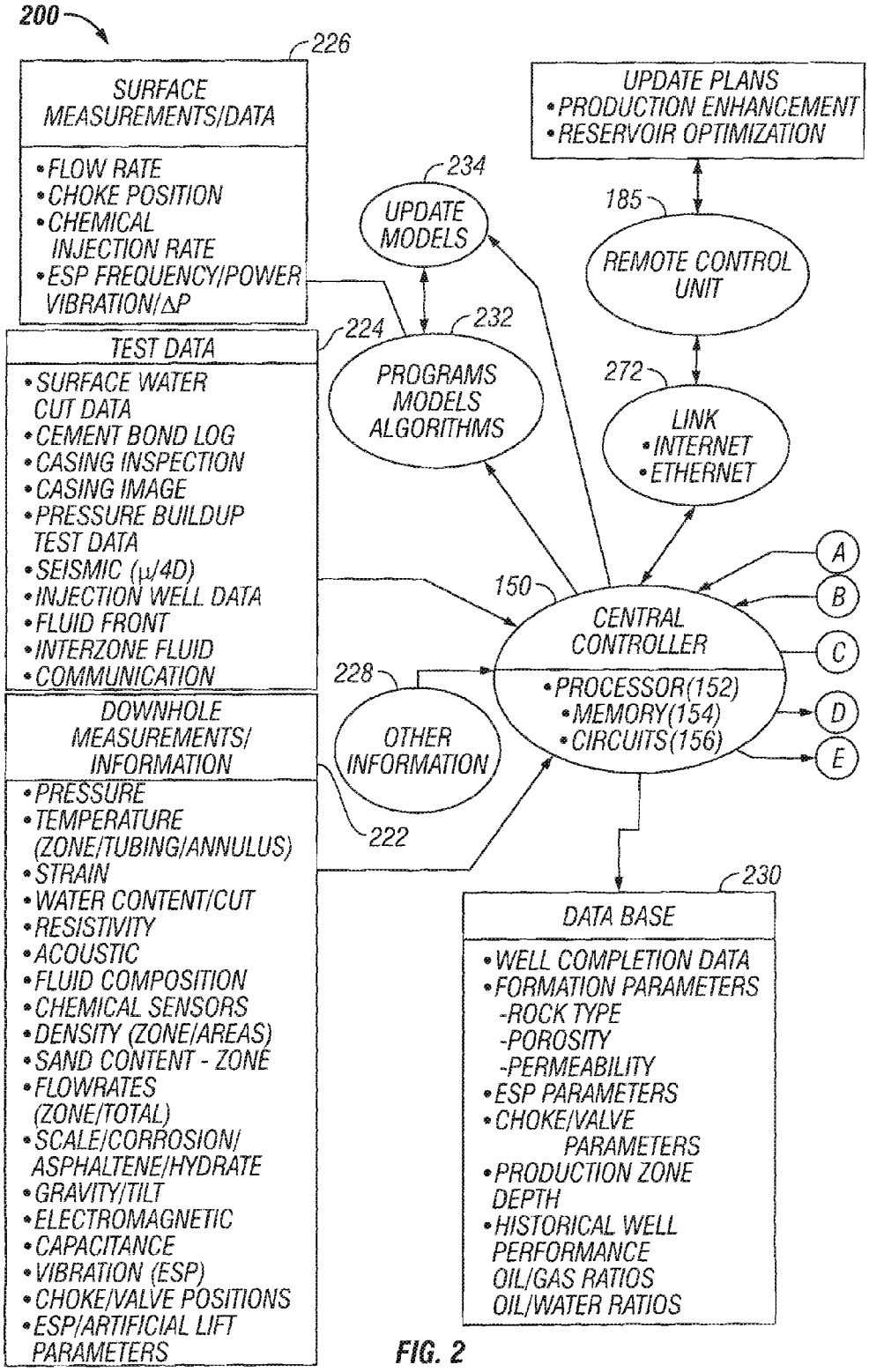
FIG. 2 is an exemplary functional diagram of a control system that may be utilized for managing supply of chemicals to a well system, including the system shown in FIGS. 1A and 1B.
Figure 2:
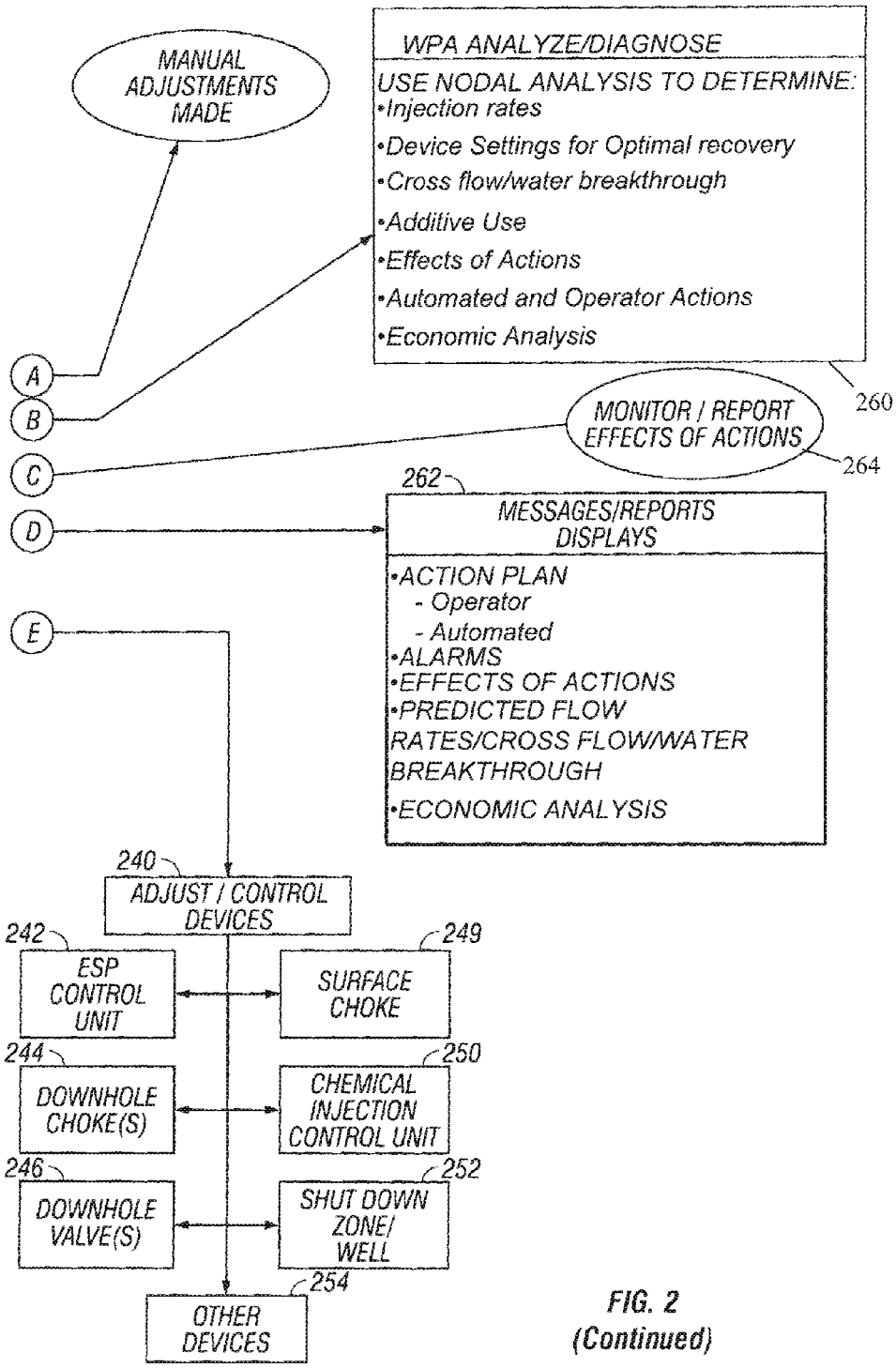

FIG. 2 shows an exemplary functional diagram of well control system 200 that may be utilized to estimate certain characteristics of fluid produced from each production zone, effects of chemicals present in the production fluid on various devices downhole and manage the supply of additives to a well system, including system 10 shown in FIGS. 1A and 1B. The system 200, in one aspect, utilizes a computer program, referred to herein as a well performance analyzer ("WPA"), which is described in more detail later, to estimate or predict the: physical condition of one or more devices; presence and/or extent of one or more chemicals, such as scale, corrosion, paraffin, hydrate, hydrogen sulfide, emulsion, asphaltene, etc.; effects of such chemicals on the equipment in the well and at the surface; effect of such chemicals on fluid produced from each production zone; amount of water produced from each production zone; an anomalous condition, such as a water breakthrough or cross-flow condition; flow-rate changes for each production zone; pressure and temperature changes for each production zone; etc. and in response to one or more such determinations manage the supply of additives to the well and the surface treatment unit so as to increase the life of the equipment in the system 10 and/or enhance or maximize production of hydrocarbons from the well. The system 200 may determine: a set of actions that may be taken to mitigate the effects of the presence of chemicals; send messages, present analysis and the set of actions to an operator and remote locations; determine the impact of particular actions taken by the operator; automatically take certain actions, including controlling the operation of one or more devices, such as chokes, valves, ESP, chemical injection pump, etc. to mitigate negative impact of the presence of chemicals downhole so as to increase the life of devices and/or to enhance, optimize or maximize production of fluids from one or more production zones. The system 200, in another aspect, may receive command actions from the remote controller and act in response thereto to manage the supply of additives into the well, pipelines and the surface treatment facilities. The system 200 also may compute anticipated production rates: (i) based on the actions taken by the operator or by the controller; (ii) based on the suggested set of actions prior to taking such actions; and (iii) perform economic analysis, such as a Net Present Value Analysis, based on such production rates for each production zone.

As shown in FIG. 2, the 200 includes a central control unit or controller 150 that may include one or more processors, such as a processor 152, suitable memory devices 154 and associated circuitry 156 that are configured to perform various functions and methods described herein. The system 200 may include a database 230 stored in a suitable computer-readable medium that is accessible to the processors 152. The database 230 may include: (i) well completion data, including but not limited to the types and locations of the sensors in the well 50 and the measurements made by such sensors (sensor parameters), types and locations of devices in the system 10 and their parameters, such as types of chokes and the discrete positions such chokes can occupy, valve types and sizes, valve positions, casing thickness, cement bond thickness, well diameter, well profile, etc.; (ii) formation parameters, such as rock types for various formation layers, porosity, permeability, mobility, resistivity, depth of various formation layers, depth and locations of the production zones, inclination of the well sections, etc.; (iii) sand screen parameters; (iv) tracer information; (v) ESP parameters, such as horsepower, frequency range, operating pressure range, maximum allowable pressure differential across the ESP, operating temperature range, and a desired operating envelope; (vi) historical well performance data, including production rates over time for each production zone, pressure and temperature values over time for each production zone and for the wells in the same or nearby fields; (vii) current and prior choke and valve settings; (viii) intervention and remedial work information; (ix) sand and water content corresponding to each production zone over time; (x) initial seismic data (two-dimensional or three-dimensional seismic maps) and updated seismic data (four-dimensional seismic maps); (xi) waterfront monitoring data; (xii) microseismic data that may relate to seismic activity caused by a fluid front movement, fracturing, etc.; (xii) inspection logs, such as obtained by using acoustic or electrical logging tools that provide: an image of the casing showing pits, gouges, holes, and cracks in the casing; condition of the cement bond between the casing and the well wall, etc.; (xiii) the types and amounts of various additives that have been used in the well and which may be used corresponding to various downhole conditions; (xiv) history of the levels and locations of various chemicals, such as scale, corrosion, hydrate, hydrogen sulfide, asphaltene, etc. in the well; (xv) impact of prior actions taken relating to the operation of the well, including that of the injection of additives in the well; and (xvi) and any other data that is desired to be used by the controller 150 for monitoring the various parameters of the well for managing the supply of the additives to the well 50.

During the life of a well one or more tests (collectively designated by numeral 224) may be performed to estimate the health of various well elements and various parameters of the production zones and the formation layers surrounding the well. Such tests may include, but are not limited to: casing inspection tests using electrical or acoustic logs for determining the condition of the casing and formation properties; well shut-in tests that may include pressure build-up or pressure transients, temperature and flow tests; seismic tests that may use a source at the surface and seismic sensors in the well (which may be permanently installed sensors) to determine water front and bed boundary conditions; microseismic measurement responsive to a downhole operation, such as a fracturing operation or a water injection operation; fluid front monitoring tests; secondary recovery tests, etc. Any and all such test data 224 may be stored in a memory 154, which is accessible to the processor 152 for managing the supply of the additives to the well and to perform other functions and operations described herein.

Additionally, the processor 152 of system 200 may periodically or continually access the downhole sensor measurement data 222, surface measurement data 226 and any other desired information or measurements 228. The downhole sensor measurements 222 include, but are not limited to: information relating to pressure; temperature; flow rates; water content or water cut; resistivity; density; viscosity; sand content; chemical characteristics or compositions of fluids, including the presence, amount and location of corrosion, scale, paraffin, hydrate, hydrogen sulfide and asphaltene; gravity; inclination; electrical and electromagnetic measurements; oil/gas and oil/water ratios; and choke and valve positions. The surface measurements 226 may include, but are not limited to: flow rates; pressures; temperature; choke and valve positions; ESP parameters; water content determined at the surface; chemical injection rates and locations; tracer detection information, etc.

The system 200 also includes programs, models and algorithms 232 embedded in one or more computer-readable media that are accessible to the processor 152 to execute instructions contained in the programs. The processor 152 may utilize one or more programs, models and algorithms to perform the various functions and methods described herein. In one aspect, some of the programs, models and algorithms 232 may be in the form of the WPA 260 that is used by the processor 152 to analyze some or all of the measurement data 222, 226, test data 224, information in the database 230 and any other desired information made available to the processor to determine a desired action plan or a set of desired actions to be taken, which when taken will manage the supply of the additives to the well in a manner that will enhance the life of the equipment and/or production from the well. The WPA may simulate the effects of such actions on the production rates, perform comparative analysis between competing sets of potential action plans, monitor the effects of the actions taken by an operator or the controller 150 and perform economic analysis, such as a net present value analysis based on the proposed action plans. In one aspect, WPA may suggest the action plan that may maximize the net present value for the well. The well performance analyzer may utilize a forward looking model, such a nodal analysis, neural network, an iterative process or another suitable algorithm.

Referring now to FIGS. 1A, 1B and 2, when the well is put in operation, the flow rate from each zone is typically set according to a production plan for the each zone of the well to optimize production form the field. As the well produces formation fluid, the reservoir depletes, which results in altering downhole pressure, temperature, fluid flow rate and the composition of the fluid that enters the well. Typically, the amount of water produced increases. Often more sand is produced as the reservoir depletes and the sand screens wear out. These changes along with the continued use of the equipment in the relative harsh downhole environment can degrade the downhole equipment and the cement bond. Changes in the fluid mixture can alter the manner in scale, corrosion, hydrate, emulsions and asphaltene are formed. Asphaltene can clog the chokes, valves and ESP. Sand production can damage screens, valves, chokes and ESP. Therefore, it becomes desirable to proactively alter the chemical injection to inhibit the formation of scale, corrosion, asphaltene, emulsion and hydrate to mitigate their potential affects. It also is desirable to inject the optimum quantities of additives that will increase the life of the equipment and provide enhanced or maximum production of hydrocarbons.

Also, water breakthrough can occur at one or more production zones, which can damage downhole equipment and cause excessive formation of one or more of the undesirable chemicals. In such a case, injecting larger amounts of additives from the surface may not be adequate to stop the damage. In such cases, it is desirable to predict the water breakthrough and take actions prior to the occurrence of the water breakthrough, which may include altering flow rates form the affected zones, speed of ESP and the supply of the additives.

Also, cross flow between zones can occur when the pressure in an upper production zone (such as production zone 52*a*) becomes greater than the pressure in a lower production zone (such as production zone 52*b*). When cross flow occurs, the fluid from the upper production zone stars to flow into the lower production zone, which results in the loss of hydrocarbons and can significantly reduce production of the formation fluid to the surface and can also damage the well. Under such a scenario, the fluid produced by the upper production zone may drain into the lower production zone, or the fluid from the lower production zone may not be lifted to the surface, thereby causing loss of hydrocarbons. Such a condition may cause damage to one or more devices in the wellbore, such as the ESP 30 and also may cause damage to a formation or the wellbore in general. Thus, it also may be desirable to predict the occurrence of a cross flow condition and manage the production of fluids from each zone and the supply of additives.

In the system, 200, the central controller 150 may continually monitor the information from the various sensors and determines the presence and amounts of one or more downhole parameter, including, but not limited to scale, hydrate, corrosion, asphaltene, hydrogen sulfide, water content from each production zone, density, resistivity, and the health and condition of the various equipment. The central controller 150 also may continually monitor pressure corresponding to each production zone and the rate of change of pressure over time and predict therefrom using the WPA 260 the occurrence of a cross flow condition. The central controller 150 also using the WPA and one or more programs and algorithms estimate the water produced from a zone, the location of an associated water front and predict the extent and timing of the occurrence of a water breakthrough. The central controller 150 using the WPA 260 then determines a set of actions that may include the injection rate for additives to be injected at each injection point in the well and the new setting for one or more devices downhole, which actions when implemented will increase the life of one or more equipment and/or enhance or maximize the production from the well. The WPA 160 may utilize a nodal analysis, neural network, or other models and/or algorithms to determine or predict any one of the parameters and actions described herein. The WPA 260 also may utilize current measurements of chemicals, pressure, flow rates, temperature and/or historical, laboratory or other synthetic data to determine or predict the various parameters and to determine the desired action or set of actions described herein.

Upon the detection and/or or prediction of a condition relating to the management of the supply of additives, the central processor 150 using the WPA 260 and other programs 232 determines the action or actions that may be taken to mitigate and or eliminate the negative effects of the determined condition. Such actions may include, but are not limited to: altering flow from a particular production zone; shutting in a particular al production zone or the entire well; increasing fluid flow from one production zone while decreasing the fluid from another production zone; altering the operation of an artificial lift mechanism, such as altering the frequency of an ESP; and performing a secondary operation, such as fluid injection into a formation, etc. The desired settings may include new settings for chokes, valves, and ESP. The WPA 260 then determines the amounts or flow rates for the additives to be injected at each injection point. These settings and flow rates may be chosen based on any selected criteria, including increase in the life of one or more equipment, desired production rates, an economic analysis, such as a net present value, and/or optimizing or maximizing production from a zone or the well.

Once the central controller 150 using the WPA and/or other programs and algorithms determines the actions to be taken, it sends messages, alarms and reports 262 relating to new settings for the additives and other devices. Such information may include specific actions to be taken by an operator, the actions that are automatically taken by the controller 150, net present value analysis information, graphical information relating to the chemical injection history and cross flow condition, new settings of the various devices, etc. as shown at 260. These messages may be displayed at a suitable display located at one or more locations, including at the well site and/or at a remote control unit 185. The information may be transmitted by any suitable data link, including an Ethernet connection and the Internet 272 and may be any form, such as text, plots, simulated picture, email, etc. The information sent by the central controller 150 may be displayed at any suitable medium, such as a monitor. The remote locations may include client locations or personnel managing the well from a remote office. The central controller 150 utilizing data, such as current choke positions, ESP frequency, downhole choke and valve positions, chemical injection unit operation and any other information 226 may determine one or more adjustments to be made or actions to be taken relating to the operation of the well, which operations when implemented are expected to mitigate or eliminate certain negative effects of the actual or potential determined condition of the well 50.

The WPA 260, in one aspect, may use a forward looking model, which may use a nodal analysis, neural network or another algorithm to estimate or assess the effects of the suggested actions and to perform an economic analysis, such as a net present value analysis based on the estimated effectiveness of the actions. The WPA 260 also may provide chemical injection rates for over a future time period and calculate the anticipated bulk volumes needed over time periods to replenish the supply of such chemicals at the well site and the corresponding costs. The WPA 260 also may provide cost of chemical usage for each production zone in relation to the hydrocarbons produced from its corresponding zone. The WPA 260 also may provide effectiveness of alternative action plans and the comparative economic analysis for such alternative action plans. The WPA also may use an iterative process to arrive at an optimal set of actions to be taken by the operator and/or the central controller 150. The central controller 150 may continually monitor the well performance and the effects of the actions 264 and send the results to the operator and the remote locations. The central controller 150 may update the models, expected chemical injection rates and the expected flow rates from each production zone based on the new settings as shown at 234.

In one aspect, the central controller 150 may be configured to wait for a period of time for the operator to take the suggested actions (manual adjustments 265) and in response to the adjustments made by the operator determine the effects of such changes on the cross flow situation and the performance of the well. The controller may send additional messages when the operator fails to take an action and may initiate actions. In such case, the controller may wait to send commands to the controller 80 that controls the operation of the chemical injection unit.

In another aspect, the central controller 150 may be configured to automatically initiate one or more of the recommended actions, for example, by sending command signals to the selected device controllers, such as to ESP controller to adjust the operation of the ESP 242; control units or actuators (160, FIG. 1A and element 240) that control downhole chokes 244, downhole valves 246; surface chokes 249, chemical injection control unit 250; other devices 254, etc. Such actions may be taken in real time or near real time. The central controller 150 continues to monitor the effects of the actions taken 264. In another aspect, the central controller 150 or the remote controller 185 may be configured to update one or more models/algorithms/programs 234 for further use in the monitoring of the well. Thus, the system 200 may operate in a closed-loop form to continually monitor the performance of the well, detect and/or predict cross flow conditions, determine actions that will mitigate negative effects of cross flow, determine the effects of any action taken by the operator, perform economic analysis so as to enhance or optimize production from one or more production zones.

The central controller 150 may be configured or programmed to effect the recommended actions directly or through other control units, such as the ESP control unit 130 and the additive injection controller 80. In another aspect, the controller may perform a nodal analysis to determine the desired changes or actions and proceed to effect the changes as described above. In another aspect, the central processor may transmit information to a remote controller 185 via a suitable link, such a hard link, wireless link or the Internet, and receive instructions from the remote controller 185 relating to the recommended actions. In another aspect, the central controller 150 or the remote controller 185 may perform a simulation based on the recommended action to determine the effect such actions will have on the operations of the wellbore. If the simulation shows that the effects fail to meet certain preset criterion or criteria, the processor performs additional analysis to determine a new set of actions that will meet the set criterion or criteria. It should be understood that separate controllers, such as controllers 80, 130 and 150 are shown merely for ease of explaining the methods and concepts described herein. In embodiments, a single local controller, such as controller 150 or a remote controller, such as controller 185, or a combination of any such controllers may be utilized to cooperatively control the various aspects of the system 10. Additionally, the central controller 150 may update the database management system 199 based on the operating conditions of the wellbore, which information may be used to update the models used by the controller 150 for further monitoring and management of the wellbore 50. The communication via the Ethernet or the Internet enables two-way communication among the operator and personnel at the wellsite and remote locations and allows such personnel to log into the database and monitor and control the operation of the well 50. Also, it should be understood that the present description refers to a well with two production zones merely for ease of explanation. In aspects, embodiments can be utilized in connection with two or more wellbores, each of which may intersect the same production zones or different production zones. Thus, while cross flow between two or more production zones intersected by the same wellbore have been discussed, it should be appreciated that system, methods and concepts described herein may be used to determine undesirable flow conditions between any number of production zones that are drained by the same or different wells. Additionally, it should be appreciated that a cross flow is only an illustrative of flow condition that can impact production efficiency. In aspects, embodiments can be configured to evaluate data from wellbore sensors to determine whether the data or data trends indicate the occurrence of any preset or predetermined flow condition.

Still referring to FIGS. 1A, 1B, 2A and 2B, the disclosure herein in one aspect provides a method of producing fluid from a well that comprises comprising: determining a first fluid flow rate from at least one production zone of the well corresponding to a first setting of at least one flow control device in the well; determining a first injection rate for the additive into the well; determining at least one characteristic of the fluid in the well; determining a set of actions using a computer model that utilizes a plurality of inputs which include the determined first fluid flow rate, first injection rate and the characteristic of the fluid, wherein the set of actions provide at least a second setting for the at least one fluid flow control device and a second injection rate for the additive. The method in another aspect may further configure the well corresponding to the determined set of actions. The at least one characteristic of the fluid may be one of: (i) scale; (ii) corrosion (iii) hydrate; (iv) emulsion; (v) asphaltene; (vi) hydrogen sulfide; and (vii) sand. Also, the plurality of inputs may further include at least one measurement relating to health of a device in the well. The device may be one of: (i) an electrical submersible pump; (ii) a surface-controlled choke; (iii) a surface-controlled valve; (iii) a casing in the well; an (iv) a cement bond between a casing in the well and a formation. In another aspect, the method may comprise predicting an occurrence of a water breakthrough into the well using the computer model and determining the set of actions based at least in part on the predicted water breakthrough. The method in another aspect may also comprise predicting an occurrence of a cross-flow condition relating to the at least one production zone using the computer model; and determining the set of actions based at least in part on the predicted cross-flow condition.

Further, the plurality of inputs used by the computer model may further include one or more measurements made for one or more parameters that include: pressure; temperature; fluid flow rate at the surface; an operating parameters of an electrical submersible pump in the well; water content in the fluid produced by the well; resistivity; density of the produced fluid; composition of the produced fluid; capacitance relating to the produced fluid; vibration; an acoustic property relating to casing; an acoustic property of a subsurface formation; an image of a section of a casing in the well; an image of a cement bond between a casing in the well and a surrounding formation; differential pressure across a device in the well; oil-water ratio; gas-oil ratio; and oil-water ratio.

In another aspect, the method may further comprise estimating the production of the fluid from the well over a selected time period based on implementing the set of actions and computing an economic value relating to the estimated production of the fluid from the well. In any aspect, the method may utilize a model that uses a nodal analysis, neural network analysis and/or a forward looking analysis.

In another aspect, the disclosure provides a computer system for use in supplying of an additive into a well, which system may include: a database that contains information relating to a plurality of devices in the well, fluid flow measurements from at least one production zone and injection rates for the additives into the well; a computer model embedded in a computer-readable medium for determining a set of actions for the well using a plurality of inputs; a processor that utilizes the computer model and the information in the database and determines: a fluid first fluid flow rate from the at least one production zone corresponding to a first setting of at least one flow control device in the well; a first injection rate for at least one additive into the well; a characteristic of the fluid in the well; and a set of actions that includes a second injection rate for the additive in the well and a second setting for the at least one flow control device, which settings will provide increased life of at least one device in the well and enhanced production of the fluid from the well. In another aspect, the processor further may send the set of actions to one or more operators and/or one or more remote units. The processor also may implement one or more actions in the set of actions automatically. The processor further may predict an occurrence of a water breakthrough into the well and/or a cross-flow condition and determine the set of actions based on such determinations.

In another aspect, the disclosure provides a computer-readable medium containing a computer program model that is accessible to a processor to execute instructions contained in the computer program, wherein the computer program comprises: a set of instructions to access a data base that contains information relating to a plurality of devices in the well, fluid flow measurements from at least one production zone and injection rates for additives into the well; a set of instructions to determine a first fluid flow rate from at least one production zone corresponding to a first setting of at least one flow control device in the well; a set of instructions to determine a first injection rate for at least one additive into the well; a set of instructions to estimate at least one characteristic of the fluid in the well; and a set of instructions to determine a set of actions using a computer model, which set of actions includes at least a second injection rate for the additive and a second setting for the at least one flow control device, which settings will provide increased life of at least one device in the well and an enhanced production of the fluid from the well. The computer program may also include a set of instructions to estimate a production rate of hydrocarbons from the well based on the set of actions and a set of instructions to determine an economic value for the well based on the production rate of the hydrocarbons from the well, such as a net present value.

While the foregoing disclosure is directed to certain disclosed embodiments and methods, various modifications will be apparent to those skilled in the art. It is intended that all modifications that fall within the scopes of the claims relating to this disclosure be deemed as part of the foregoing disclosure.

What is claimed is:

1. A method of producing fluid from a well, comprising:

using a first sensor to determine a first fluid flow rate of a fluid from at least one production zone of the well corresponding to a first setting of at least one flow control device for controlling flow of the fluid from the at least one production zone into a production tubing in the well;

using a second sensor to determine at least one chemical characteristic of the fluid from the at least one production zone;

using a third sensor to determine a first injection rate of an additive that controls the chemical characteristic of the fluid from the at least one production zone, the additive injected at a downhole location; and determining a set of actions using a processor and a computer model that utilizes a plurality of inputs which include the determined first fluid flow rate, first injection rate and the at least one chemical characteristic of the fluid from the at least one production zone, wherein the set of actions provide performing a simulation for the effects of a second injection rate for the additive that maintains the at least one chemical characteristic of the fluid from the at least one production zone within a predetermined limit on a production rate of the well, and applying the second injection rate for additive when the simulated production rate is within a selected criteria.

2. The method of claim 1 further comprising configuring the well corresponding to the determined set of actions.

3. The method of claim 2, wherein the at least one chemical characteristic of the fluid from the at least one production zone is selected from a group consisting of: (i) scale; (ii) corrosion; (iii) hydrate; (iv) emulsion; (v) asphaltene; (vi) hydrogen sulfide; and (vii) sand.

4. The method of claim 1, wherein the plurality of inputs further includes at least one measurement relating to health of a device in the well.

5. The method of claim 4, wherein the device is selected from a group consisting of: (i) an electrical submersible pump; (ii) a surface-controlled choke; (iii) a surface-controlled valve; (iv) a casing in the well; and (v) a cement bond between a casing in the well and a formation.

6. The method of claim 1 further comprising:

predicting an occurrence of a water breakthrough into the well using the computer model; and determining the set of actions based at least in part on the predicted occurrence of water breakthrough.

7. The method of claim 1 further comprising:

predicting an occurrence of a cross-flow condition relating to the at least one production zone using the computer model; and determining the set of actions based at least in part on the predicted occurrence of cross-flow condition.

8. The method of claim 1, wherein the plurality of inputs further includes at least one measurement for a parameter selected from a group consisting of: pressure; temperature;

fluid flow rate at the surface; an operating parameter of an electrical submersible pump in the well; water content in the fluid produced by the well; resistivity; density of the produced fluid; composition of the produced fluid; capacitance relating to the produced fluid; vibration; an acoustic property relating to casing; an acoustic property of a subsurface formation; an image of a section of a casing in the well; an image of a cement bond between a casing in the well and a surrounding formation; differential pressure across a device in the well; oil-water ratio; gas-oil ratio; and oil-water ratio.

9. The method of claim 1 further comprising estimating the production of the fluid from the well over a selected time period based on implementing the set of actions and computing an economic value relating to the estimated production of the fluid from the well.

10. The method of claim 1, wherein the model uses at least one of: (i) a nodal analysis; (ii) a neural network analysis; and (iii) a forward looking analysis.

11. A computer system for use in supplying an additive into a well, comprising:

a database configured to contain information relating to a plurality of devices in the well, fluid flow measurements from at least one production zone and injection rates for the additive into the well;

a computer model embedded in a computer-readable medium for determining a set of actions for the well using a plurality of inputs; and a processor configured to utilize the computer model and the information in the database that includes a first fluid flow rate from the at least one production zone corresponding to a first setting of at least one flow control device controlling flow of the fluid from the at least one production zone into a production tubing in the well, a chemical characteristic of the fluid from the at least one production zone, and a first injection rate of at least one additive injected at a downhole location to perform a simulation for the effects of a second injection rate for the additive that maintains the at least one chemical characteristic of the fluid from the at least one production zone within a predetermined limit on a production rate of the well, and apply the second injection rate for the additive when the simulated production rate is within a selected criteria.

12. The computer system of claim 11, wherein the processor is further configured to send the set of actions to at least one of: (i) an operator at the wellsite; and (ii) a remote unit.

13. The computer system of claim 11, wherein the processor is further configured to send instructions to an actuator to automatically set the first injection rate for the additive to the second injection rate.

14. The computer system of claim 11, wherein the processor is further configured to:

predict an occurrence of a water breakthrough into the well using the computer model; and determine the set of actions based at least in part on the predicted occurrence of water breakthrough.

15. The computer system of claim 11, wherein the processor is further configured to:

predict an occurrence of a cross-flow condition relating to the at least one production zone using the computer model; and determine the set of actions based at least in part on the predicted occurrence of cross-flow condition.

16. The computer system of claim 11, wherein the processor is further configured to:

estimate a production rate for the well over a selected time period based on the set of actions; and estimate an economic factor for the well based on the estimated production rate for the well.

17. The computer system of claim 11, wherein the plurality of inputs further includes at least one measurement for a parameter selected from a group consisting of: pressure; temperature; fluid flow rate at the surface; an operating parameter of an electrical submersible pump in the well; water content in the fluid produced by the well; resistivity; density of the produced fluid; composition of the produced fluid; capacitance relating to the produced fluid; vibration; an acoustic property relating to casing; an acoustic property of a subsurface formation; an image of a section of a casing in the well; an image of a cement bond between a casing in the well and a surrounding formation; differential pressure across a device in the well; oil-water ratio; gas-oil ratio; and oil-water ratio.

18. A non-transitory computer-readable medium containing a computer program that is accessible to a processor to execute instructions contained in the computer program, wherein the computer program comprises:

a set of instructions to access a database that contains information relating to a plurality of devices in the well, fluid flow measurements from at least one production zone and injection rates for additives into the well;

a set of instructions to determine a first fluid flow rate of a fluid from at least one production zone corresponding to a first setting of at least one flow control device controlling the flow of the fluid from the at least one production zone into a production tubing in the well;

a set of instructions to estimate at least one chemical characteristic of the fluid from the at least one production zone;

a set of instructions to determine a first injection rate of at least one additive injected at a downhole location to control the at least one chemical characteristic of the fluid from the at least one production zone; and a set of instructions to determine a set of actions using a computer model utilizing a plurality of inputs which include the first fluid flow rate, the first injection rate, and the at least one chemical characteristic of the fluid from the at least one production zone, which set of actions includes performing a simulation for the effects of a second injection rate for the additive into the well that maintains the at least one chemical characteristic of the fluid from the at least one production zone within a predetermined limit on a production rate of the well, and applying the second injection rate for additive when the simulated production rate is within a selected criteria.

19. The non-transitory computer-readable medium of claim 18, wherein the computer program further comprises: a set of instructions to estimate a production rate of hydrocarbons from the well based on the set of actions.

20. The non-transitory computer-readable medium of claim 19, wherein the computer program further comprises a set of instructions to determine an economic value for the well based on the production rate of the hydrocarbons from the well.

* * * * *